United States Patent [19]

Koblenzer

[11] 4,353,323

[45] Oct. 12, 1982

[54] APPARATUS FOR THE TREATING OF ARTICLES

[75] Inventor: Heinz Koblenzer, Filderstadt, Fed. Rep. of Germany

[73] Assignee: Langbein-Pfanhauser Werke AG, Neuss, Fed. Rep. of Germany

[21] Appl. No.: 256,600

[22] Filed: Apr. 22, 1981

[30] Foreign Application Priority Data

Apr. 23, 1980 [DE] Fed. Rep. of Germany ..... 3015524

[51] Int. Cl.[3] ..... B05C 11/10

[52] U.S. Cl. ..... 118/61; 118/69; 118/425; 118/428; 134/11; 134/104; 134/107; 427/335; 148/6.15 R

[58] Field of Search ..... 427/335, 374.1; 118/61, 118/69, 428; 62/238.1, 238.6, 238.7, 324.3; 134/11, 31, 104, 105, 107

[56] References Cited

U.S. PATENT DOCUMENTS 3,070,463 12/1962 Barday ..... 134/11
3,308,877 3/1967 Gertis ..... 62/324.3
3,916,638 11/1975 Schmidt ..... 62/238.1

FOREIGN PATENT DOCUMENTS 2624345 12/1976 Fed. Rep. of Germany .

*Primary Examiner*—Ralph S. Kendall
*Attorney, Agent, or Firm*—Karl F. Ross

[57] ABSTRACT

An apparatus for treating articles with a solvent, a solvent-containing liquid such as a lacquer, or with solvent vapors, comprises an open treating vessel provided with a device for raising and lowering the articles in the vessel and a heating unit at the bottom of the vessel for heating solvent therein. Around the wall of the vessel, above the bottom thereof, cooling tubes are provided which are connected to the cold branch of a heat pump so as to condense solvent vapors which can collect in a trough below these tubes and can be returned to a compartment of the vessel adjacent the treating compartment. The hot branch of the heat pump is connected via a heat exchanger to a water boiler and heat storage tank and the heater is connected to this boiler by a pump controlled by a control device responsive to the raising and lowering of the articles.

6 Claims, 1 Drawing Figure

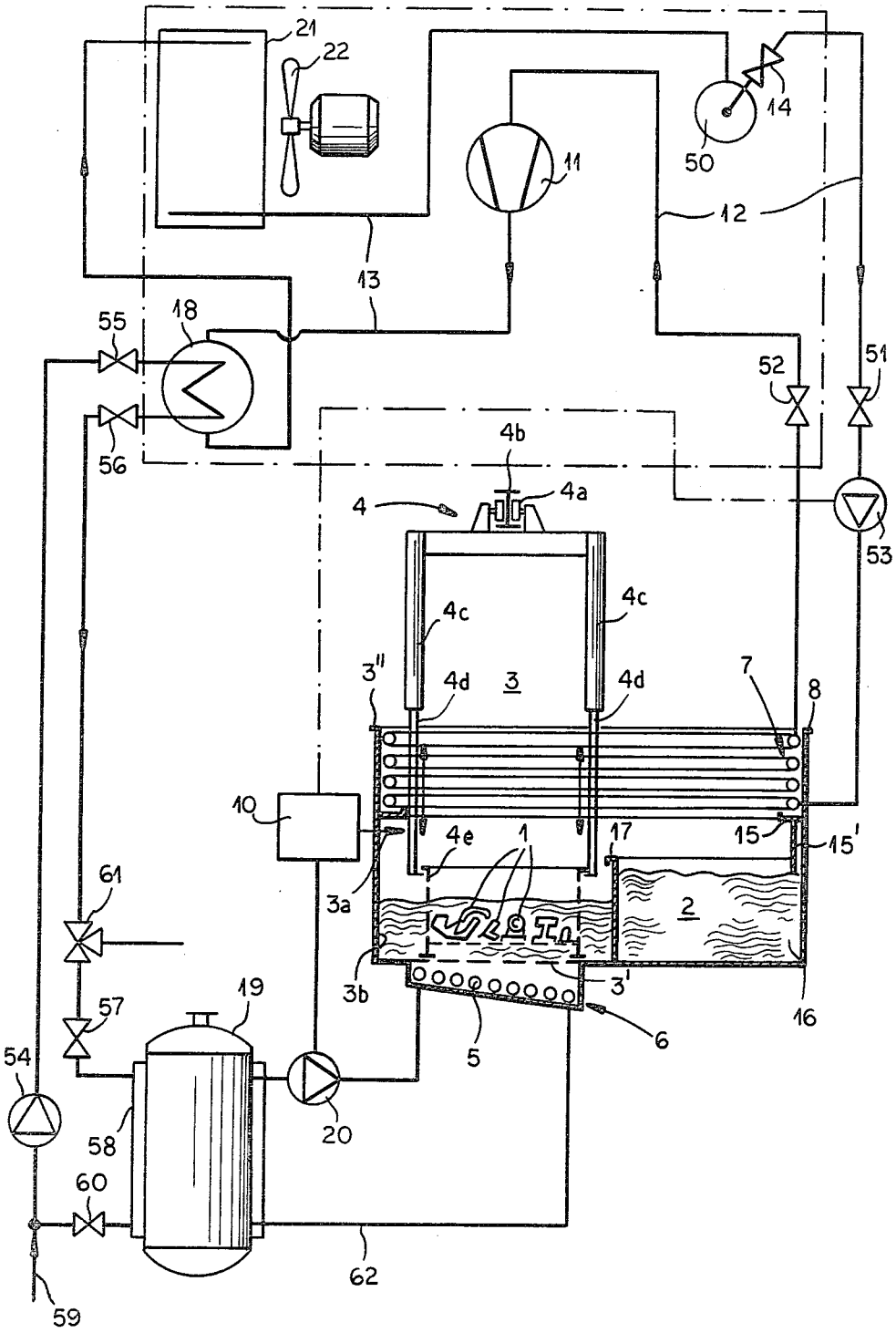
21
22
14
50
11
12
13
18
55
56
52
51
53
4b
4a
4
4c
4c
3''
4d
3
4d
7
8
10
4e
1
17
15
15'
3a
2
61
3b
3'
16
19
57
5
6
54
58
20
60
62
59

APPARATUS FOR THE TREATING OF ARTICLES

FIELD OF THE INVENTION

My present invention relates to an apparatus for the treatment of articles with a solvent, with solvent-containing liquids and with solvent vapors and, more particularly, to an apparatus for the degreasing phosphorization and lacquer-coating of articles in which a solvent, i.e. a high volatility liquid, is used. The solvents may be any liquid suitable for the purposes described or for the treatment of articles and having a relatively high vapor pressure, suitable solvents including alcohols, ketones, unsubstituted hydrocarbons, chlorinated and chlorofluoronated hydrocarbons.

BACKGROUND OF THE INVENTION

For a variety of purposes, it is frequently desirable to treat articles, e.g. solid objects usually of metal, with solvents, solvent-containing liquid or solvent vapors and such treatments can involve degreasing with solvent liquids or solvent water, phosphorization of a metal surface and lacquering or lacquer coating of objects using a liquid containing a solvent.

It is known to provide apparatus for such purposes which includes an upwardly open treatment chamber, means for raising and lowering the articles in the chamber, e.g. to immerse the articles in the liquids and remove the articles from the liquid, a heater generally at the bottom of the chamber for vaporizing solvent, and cooling and condensing means in the region of the open treatment chamber edge, i.e. above the liquid bath to condense solvent vapors.

The apparatus can include a basket in which the articles are raised and lowered. The articles can be lowered into the liquid or raised therefrom or held in contact with vapor. An apparatus of this kind is described in German patent document No. 26 24 345, a heat pump being provided in this system, with its hot branch connected to the heater and its cold branch connected to the condenser.

In this system, the solvent of the liquid also forms a heat carrier or working medium of the heat pump.

The condensing means serves to condense vapors as they rise upwardly from the solvent-containing liquid so that a minimum of solvent escapes from the vessel.

The solvent content of the air in the region of the condenser and above the chamber is, of course, dependent upon the water pressure of the solvent at the temperature of the condenser. The lower the temperature which can be sustained at the condenser surface, the greater will be the recovery of solvent for the vapor phase and thus the escape of solvent into the environment from the treating vessel can be reduced by lowering the temperature of the condenser surface. However, in conventional systems there are practical limits to the temperature to which the condenser surfaces can be lowered and hence to the recovery of solvent vapors from the water phase so that hoods and other means for evacuating these vapors must be provided to minimize environmental pollution.

OBJECTS OF THE INVENTION

The principal object of the present invention is to provide an apparatus for the treatment of articles with liquid solvent, a solvent-containing liquid or solvent vapor whereby the escape of traces of the solvent vapor into the atmosphere is minimized and the need for hoods and the like can be eliminated.

Another object of the invention is to provide a treatment apparatus for the purposes described which is of simple construction, is energy-efficient and is free from the disadvantages of earlier systems.

SUMMARY OF THE INVENTION

I have found, surprisingly, that these objects can be attained with a system of the type described, in which a water boiler and heat storage unit or tank is provided between the hot branch of the heat pump and the heater in a manner which will be described in greater detail below.

According to the invention, therefore, the treatment apparatus for treating articles, preferably metal articles, with a liquid solvent, with solvent-containing liquid or with solvent vapor, comprises an upwardly open treatment chamber the bottom portion of which is adapted to form a container for liquid and which is provided at its bottom, preferably at the lowest point thereof, with a heater for vaporizing the solvent while the upper portion of the chamber is formed with a condenser for solvent vapors.

The apparatus further comprises a device for lowering the articles into the chamber and raising the articles out of the liquid therein or out of the chamber entirely, a control device and a heat pump whose cold branch is connected to the condenser while its hot branch is connected, preferably via a heat exchanger, to the water boiler or the heat storage tank to heat the water therein. Water from this boiler can be circulated through the heater according to the invention.

According to an important feature of the invention, the control device responds to the raising and lowering of the articles in the treatment chamber to control the flow of hot water from the tank to the heater.

The invention is based upon the discovery that when, on one hand, the working media or refrigerant of the heat pump is different from the solvent and, on the other hand, the hot branch of the heat pump works via a storage tank with the heater, it is possible to bring the temperature of the condenser surfaces to a deep-cooled state well below that which has been obtainable with earlier systems so that the release of solvent vapors to the atmosphere can be markedly reduced.

This, when combined with the cut-off of the heating of the heater and the solvent liquid via the control means upon lowering or raising of the articles, eliminates the unnecessary generation of water and contributes significantly to a reduction in the release of vapor to the atmosphere to the extent that hoods, evacuated chambers and the like no longer need be used.

While the intensive cooling of the atmosphere is being effected, the resulting heat is not lost but is completely or largely recovered and stored in the water boiler heat-storage tank which can be utilized as a utility water tank to supply hot water wherever it may be required in the plant.

When the heat developed at the hot branch is greater than that which can be absorbed by the boiler, an air cooler in the hot branch may be activated to dissipate the excess heat, e.g. by turning on a fan associated with this cooler or radiator.

BRIEF DESCRIPTION OF THE FIGURE

The above and other objects, features and advantages of the present invention will become more readily apparent from the following description reference being made to the accompanying FIGURE which is a flow diagram illustrating the invention.

SPECIFIC DESCRIPTION

In the FIGURE I have shown an apparatus for the treatment of articles 1, e.g. metal articles, with liquid solvent or solvent vapors or liquid solvents. For example, the upwardly open treatment chamber 3 may contain a degreasing solvent 2 and can comprise a device for raising and lowering the articles into the solvent in this chamber 3.

The bottom of the chamber 3 can be provided with a screen 3' through which the solvent can reach a heating coil 5 forming part of a heating unit in the lowest portion 6 of the vessel.

The device 4 may comprise a carriage **4*a* adapted to ride along a rail 4*b* perpendicular to the plane of the paper from any manufacturing installation at which the articles are produced to the degreasing unit shown. The carriage 4*a* can be provided with a pair of hydraulic or pneumatic cylinders 4*c* whose piston rod 4*d* are engageable with a basket 4*e*** containing the articles to enable them to be raised and lowered in the manner described.

The upper portion of the treatment vessel 3, in the region of the mouth 3'' thereof, has a wall **3*a* above the liquid level and formed with a cooling and condensing coil 7 extending up to the mouth 8 of the vessel. Along this wall and below the condenser 7, I provide a trough 15 in which the solvent condensed collects and from which the condensate is returned by a downcomer 15' to a clean solvent tank 16, separated by the partition 17 from the tank portion 3*b*** containing the treatment solvent.

The condenser 7 is cooled by a cooling unit 9 of the refrigerator type, this unit constituting a heat pump as will be described in greater detail hereinafter. A control device responsive to raising and lowering of the basket **4*e* and the articles 1 has been represented at 10**.

The cooling unit 9 is a heat pump whose compressor has a hot branch 13 connected to its high pressure side and a cold branch 12 connected to its low pressure side. In accordance with conventional heat pump principles, the refrigerant, e.g. a chlorofluorinated hydrocarbon or fluorocarbon, such as a FREON, is compressed in the compressor and the resultant heat of compression is released in the hot branch, the refrigerant then condensing and being collected, e.g. in tank 50.

The liquid is then expanded through the expansion or throttle value 14 and is thereby cooled, the cold liquid passing through the condenser 7 to deep cool the latter and abstract heat (i.e. latent heat of condensation) which is recovered upon compression; the cycle then repeats.

The cold branch 12 is here connected directly to the condenser 7 via a pair of valves 51 and 52 and a booster pump 53.

The hot branch 13 comprises a heat exchanger 18 in series with an air cooler or radiator 21 associated with a blower or fan 22 which can be turned on as desired to dissipate surplus heat. The heat exchanger 18 serves to heat a water boiler and heat storage tank 19 with a heat carrier, e.g. water displaced by a pump 54 via valve 55 through the heat exchanger 18 and returned by valve 56 and a valve 57 to the jacket 58 of the boiler. Feed water can be supplied at 59 and the intake side of the pump 54 is connected by valve 60 to the jacket 58. Hot water can be tapped from the system at another valve 61.

The boiler 19 can serve as a utility water supply so as to prepare and deliver hot water for any purpose required in the plant, the connections for the utility water lines being omitted in the drawing.

However, the upper portion of the boiler 19 is connected by the pump 20 to the heating coil 5 and the water return 62 extends to the bottom of the boiler. The pump 20 is motor driven in response to the controller 10 which, in turn, responds to the raising and lowering of the basket.

Naturally, when the articles 1 are to be treated with the solvent liquid or with a solvent-containing liquid, the basket is immersed in the solvent as shown in the drawing. During this stage, heater 5 is cut off by the control 10 and the condenser 7 fully operative.

When, however, a vapor treatment of the articles is desired, the basket is positioned above the liquid and the heater 5 is turned on by the control 10.

During operation, the surfaces of the condenser 7 are deep cooled so that solvent vapors do not escape materially into the environment. The control device 10 can, of course, be used to cut off the cooler as well, e.g. by controlling the pump 53.

Preferably in the cut-off state of the heater 5, the latter operates in idling mode, i.e. there is no fixed barrier to flow in either direction although the heater no longer continues to supply heat to the solvent at the rate which applied when hot water is forced therethrough.

This can be achieved readily by simply turning off the pump 20 and forming this pump as an impeller pump, the idling mode then representing a gravitational or convective flow.

I claim:

1. An apparatus for treating articles with a solvent comprising:

an upwardly open vessel having a bottom and adapted to receive liquid solvent therein;

a heater at said bottom for heating solvent in said vessel to vaporize same, said vessel having an upper wall portion above said solvent;

a condenser formed along said upper wall portion for condensing vapor of said solvent;

a heat pump having a circulating heat carrier and formed with a hot branch including a heat exchanger and a cold branch, said cold branch being connected to said condenser;

a water-containing heat storage tank and boiler adapted to be heated by said hot branch;

means for circulating a fluid for heating water for said tank through said heat exchanger;

means for feeding water from said tank to said heater;

means for lowering articles into said vessel and raising articles in said vessel for treatment of said articles with said solvent in said vessel; and control means connected to said feeding means for controlling same in response to the raising and lowering of articles in said vessel and including means, effective upon raising of said articles in said vessel to operate said feeding means in an idling mode enabling convective movement of water through said heater from said tank.

2. The apparatus defined in claim 1 wherein said feeding means includes a rotary impeller pump connected between said tank and said heater.

3. The apparatus defined in claim 2 wherein said tank is a utility water tank.

4. The apparatus defined in claim 3 wherein said hot branch further comprises an air cooler provided with a fan.

5. The apparatus defined in claim 4, further comprising a trough disposed below said condenser for collecting condensate therefrom, said vessel having a partition subdividing same into a treatment chamber and a collection chamber to condensate from said trough being delivered to said collection chamber.

6. The apparatus defined in claim 5 wherein said articles are received in a basket and the means for raising and lowering said articles includes fluid operated cylinders engageable with said basket.

* * * * *